US008959015B2

(12) United States Patent
Lee et al.

(10) Patent No.: US 8,959,015 B2
(45) Date of Patent: Feb. 17, 2015

(54) APPARATUS FOR ENCODING AND DECODING OF INTEGRATED SPEECH AND AUDIO

(75) Inventors: Tae Jin Lee, Daejeon (KR); Seung Kwon Beack, Daejeon (KR); Minje Kim, Daejeon (KR); Dae Young Jang, Daejeon (KR); Kyeongok Kang, Daejeon (KR); Jin Woo Hong, Daejeon (KR); Hochong Park, Seoul (KR); Young-Cheol Park, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 794 days.

(21) Appl. No.: 13/054,377

(22) PCT Filed: Jul. 14, 2009

(86) PCT No.: PCT/KR2009/003854

§ 371 (c)(1),
(2), (4) Date: Jan. 14, 2011

(87) PCT Pub. No.: WO2010/008175

PCT Pub. Date: Jan. 21, 2010

(65) Prior Publication Data

US 2011/0119054 A1 May 19, 2011

(30) Foreign Application Priority Data

Jul. 14, 2008 (KR) ..... 10-2008-0068370
Jul. 7, 2009 (KR) ..... 10-2009-0061607

(51) Int. Cl.
*G10L 19/20* (2013.01)
*G10L 19/02* (2013.01)
*G10L 19/12* (2013.01)

(52) U.S. Cl.
CPC ..... *G10L 19/20* (2013.01); *G10L 19/0212* (2013.01); *G10L 19/12* (2013.01)
USPC ..... 704/200; 704/500; 704/501

(58) Field of Classification Search
USPC ..... 704/200–201, 500–503
See application file for complete search history.

(56) References Cited

U.S. PATENT DOCUMENTS 6,658,383 B2 * 12/2003 Koishida et al. ..... 704/229
7,596,486 B2 * 9/2009 Ojala et al. ..... 704/201

(Continued)

FOREIGN PATENT DOCUMENTS

CN 101202042 6/2008
JP 11-175098 7/1999

(Continued)

OTHER PUBLICATIONS

Jari Mäkinen et al., "AMR-WB+: A New Audio Coding Standard for 3rd Generation Mobile Audio Services", Proceedings. ICASSP 2005, IEEE, Mar. 18-23, 2005, pp. II 1109-II 1112.

*Primary Examiner* — Douglas Godbold
(74) *Attorney, Agent, or Firm* — Staas & Halsey LLP

(57) ABSTRACT

Provided is an apparatus for integrally encoding and decoding a speech signal and an audio signal. An encoding apparatus for integrally encoding a speech signal and an audio signal, may include: a module selection unit to analyze a characteristic of an input signal and to select a first encoding module for encoding a first frame of the input signal; a speech encoding unit to encode the input signal according to a selection of the module selection unit and to generate a speech bitstream; an audio encoding unit to encode the input signal according to the selection of the module selection unit and to generate an audio bitstream; and a bitstream generation unit to generate an output bitstream from the speech encoding unit or the audio encoding unit according to the selection of the module selection unit.

15 Claims, 10 Drawing Sheets

(56) References Cited

U.S. PATENT DOCUMENTS

| | | | | |
|---|---|---|---|---|
| 7,860,709 | B2 * | 12/2010 | Makinen | 704/219 |
| 7,876,966 | B2 * | 1/2011 | Ojanpera | 382/232 |
| 8,069,034 | B2 * | 11/2011 | Makinen et al. | 704/201 |
| 8,244,525 | B2 * | 8/2012 | Makinen | 704/208 |
| 2005/0187759 | A1 * | 8/2005 | Malah et al. | 704/200 |
| 2007/0106502 | A1 | 5/2007 | Kim et al. | |
| 2008/0010062 | A1 | 1/2008 | Son et al. | |
| 2008/0027719 | A1 | 1/2008 | Kirshnan et al. | |

FOREIGN PATENT DOCUMENTS

| | | |
|---|---|---|
| JP | 2007-538283 | 12/2007 |
| KR | 10-0614496 | 8/2006 |
| WO | 2007/083931 | 7/2007 |
| WO | WO 2008/016945 | 2/2008 |
| WO | 2008/045846 | 4/2008 |

* cited by examiner

APPARATUS FOR ENCODING AND DECODING OF INTEGRATED SPEECH AND AUDIO

CROSS REFERENCE TO RELATED APPLICATIONS

This application claims the benefit of International Application No. PCT/KR2009/003854, filed Jul. 14, 2009, and claims the benefit of Korean Application No. 10-2008-0068370, filed Jul. 14, 2008, and Korean Application No. 10-2009-0061607, filed Jul. 7, 2009, the disclosures of all of which are incorporated herein by reference.

TECHNICAL FIELD

The present invention relates to an apparatus and method for integrally encoding and decoding a speech signal and an audio signal. More particularly, the present invention relates to an apparatus and method that may solve a signal distortion problem, resulting from a change of a selected module according to a frame progress, to thereby change a module without distortion, when a codec includes at least two encoding/decoding modules, operating with different structures, and selects and operates one of the at least two encoding/decoding modules according to an input characteristic for each frame.

BACKGROUND ART

Speech signals and audios signal have different characteristics. Therefore, speech codecs for the speech signals and audio codecs for the audio signals have been independently researched using unique characteristics of speech signals and audio signals, and standard codecs have been developed for each of the speech codecs and the audio codecs.

Currently, as a communication service and a broadcasting service are integrated or converged, there is a need to integrally process a speech signal and an audio signal having various types of characteristics, using a single codec. However, existing speech codecs or audio codecs may not provide a performance demanded of a unified codec. Specifically, an audio codec having the best performance may not provide a satisfactory performance with respect to a speech signal, and a speech codec having the best performance may not provide a satisfactory performance with respect to an audio signal. Therefore, the existing codecs are not used for the unified speech/audio codec.

Accordingly, there is a need for a technology that may select a corresponding module according to a characteristic of an input signal to optimally encode and decode a corresponding signal.

DISCLOSURE OF INVENTION

Technical Goals

An aspect of the present invention provides an apparatus and method for integrally encoding and decoding a speech signal and an audio signal that may combine a speech codec module and an audio codec module and selectively apply a codec module according to a characteristic of an input signal to thereby enhance a performance.

Another aspect of the present invention also provides an apparatus and method for integrally encoding and decoding a speech signal and an audio signal that may use information of a previous module until a selected codec module is changed over time to thereby solve distortion occurring due to a discontinuous module operations.

Another aspect of the present invention also provides an apparatus and method for integrally encoding and decoding a speech signal and an audio signal that may use an additional scheme when previous module information for overlapping is not provided from a Modified Discrete Cosine Transform (MDCT) module demanding a time-domain aliasing cancellation (TDAC) operation to thereby enable the TDAC operation and perform a normal MDCT-based codec operation.

Technical Solutions

According to an aspect of the present invention, there is provided an encoding apparatus for integrally encoding a speech signal and an audio signal, the encoding apparatus including: a module selection unit to analyze a characteristic of an input signal and to select a first encoding module for encoding a first frame of the input signal; a speech encoding unit to encode the input signal according to a selection of the module selection unit and to generate a speech bitstream; an audio encoding unit to encode the input signal according to the selection of the module selection unit and to generate an audio bitstream; and a bitstream generation unit to generate an output bitstream from the speech encoding unit or the audio encoding unit according to the selection of the module selection unit.

In this instance, the encoding apparatus may further include: a module buffer to store a module identifier (ID) of the selected first encoding module, and to transmit information of a second encoding module corresponding to a previous frame of the first frame to the speech encoding unit and the audio encoding unit; and an input buffer to store the input signal and to output a previous input signal that is an input signal of the previous frame. The bitstream generation unit may combine the module ID of the selected first encoding module and a bitstream thereof to generate the output bitstream.

Also, the module selection unit may extract the module ID of the selected first encoding module to transfer the extracted module ID to the module buffer and the bitstream generation unit.

Also, the speech encoding unit may include: a first speech encoder to encode the input signal to a Code Excitation Linear Prediction (CELP) structure when the first encoding module is identical to the second encoding module; and an encoding initialization unit to determine an initial value for encoding of the first speech encoder when the first encoding module is different from the second encoding module.

Also, when the first encoding module is identical to the second encoding module, the first speech encoder may encode the input signal using an internal initial value of the first speech encoder. When the first encoding module is different from the second encoding module, the first speech encoder may encode the input signal using an initial value that is determined by the encoding initialization unit.

Also, the encoding initialization unit may include: a Linear Predictive Coder (LPC) analyzer to calculate an LPC coefficient with respect to the previous input signal; a Linear Spectrum Pair (LSP) converter to convert the calculated LPC coefficient to an LSP value; an LPC residual signal calculator to calculate an LPC residual signal using the previous input signal and the LPC coefficient; and an encoding initial value decision unit to determine the initial value for encoding of the first speech encoder using the LPC coefficient, the LSP value, and the LPC residual signal.

Also, the audio encoding unit may include: a first audio encoder to encode the input signal through a Modified Discrete Cosine Transform (MDCT) operation when the first encoding module is identical to the second encoding module; a second speech encoder to encode the input signal to a CELP structure when the first encoding module is different from the second encoding module; a second audio encoder to encode the input signal through the MDCT operation when the first encoding module is different from the second encoding module; and a multiplexer to select one of an output of the first audio encoder, an output of the second speech encoder, and an output of the second audio encoder to generate the output bitstream.

Also, when the first encoding module is different from the second encoding module, the second speech encoder may encode an input signal corresponding to a front ½ sample of the first frame.

Also, the second audio encoder may include: a zero input response calculator to calculate a zero input response with respect to an LPC filter after terminating an encoding operation of the second speech encoder; a first converter to convert, to zero, an input signal corresponding to a front ½ sample of the first frame; and a second converter to subtract the zero input response from an input signal corresponding to a rear ½ sample of the first frame. The second audio encoder may encode a converted signal of the first converter and a converted signal of the second converter.

According to another aspect of the present invention, there is provided a decoding apparatus for integrally decoding a speech signal and an audio signal, the decoding apparatus including: a module selection unit to analyze a characteristic of an input bitstream and to select a first decoding module for decoding a first frame of the input bitstream; a speech decoding unit to decode the input bitstream according to a selection of the module selection unit and to generate the speech signal; an audio decoding unit to decode the input bitstream according to the selection of the module selection unit and to generate the audio signal; and an output generation unit to select one of the speech signal of the speech decoding unit and the audio signal of the audio signal according to the selection of the module selection unit and to output an output signal.

In this instance, the decoding apparatus may further include: a module buffer to store a module ID of the selected first decoding module, and to transmit information of a second decoding module corresponding to a previous frame of the first frame to the speech decoding unit and the audio decoding unit; and an output buffer to store the output signal and to output a previous output signal that is an output signal of the previous frame.

Also, the audio decoding unit may include: a first audio decoder to decode the input bitstream through an Inverse MDCT (IMDCT) operation when the first decoding module is identical to the second decoding module; a second speech decoder to decode the input bitstream to a CELP structure when the first decoding module is different from the second decoding module; a second audio decoder to decode the input bitstream through the IMDCT operation when the first decoding module is different from the second decoding module; and a signal restoration unit to calculate a final output from an output of the second speech decoder and an output of the second audio decoder; and an output selector to select and output one of an output of the signal restoration unit and an output of the first audio decoder.

Advantageous Effects

According to example embodiments, there are an apparatus and method for integrally encoding and decoding a speech signal and an audio signal that may combine a speech codec module and an audio codec module and selectively apply a codec module according to a characteristic of an input signal to thereby enhance a performance.

According to example embodiments, there are an apparatus and method for integrally encoding and decoding a speech signal and an audio signal that may use information of a previous module until a selected codec module is changed over time to thereby solve distortion occurring due to a discontinuous module operations.

According to example embodiments, there are an apparatus and method for integrally encoding and decoding a speech signal and an audio signal that may use an additional scheme when previous module information for overlapping is not provided from a Modified Discrete Cosine Transform (MDCT) module demanding a time-domain aliasing cancellation (TDAC) operation to thereby enable the TDAC operation and perform a normal MDCT-based codec operation.

BEST MODE FOR CARRYING OUT THE INVENTION

Figure 1:
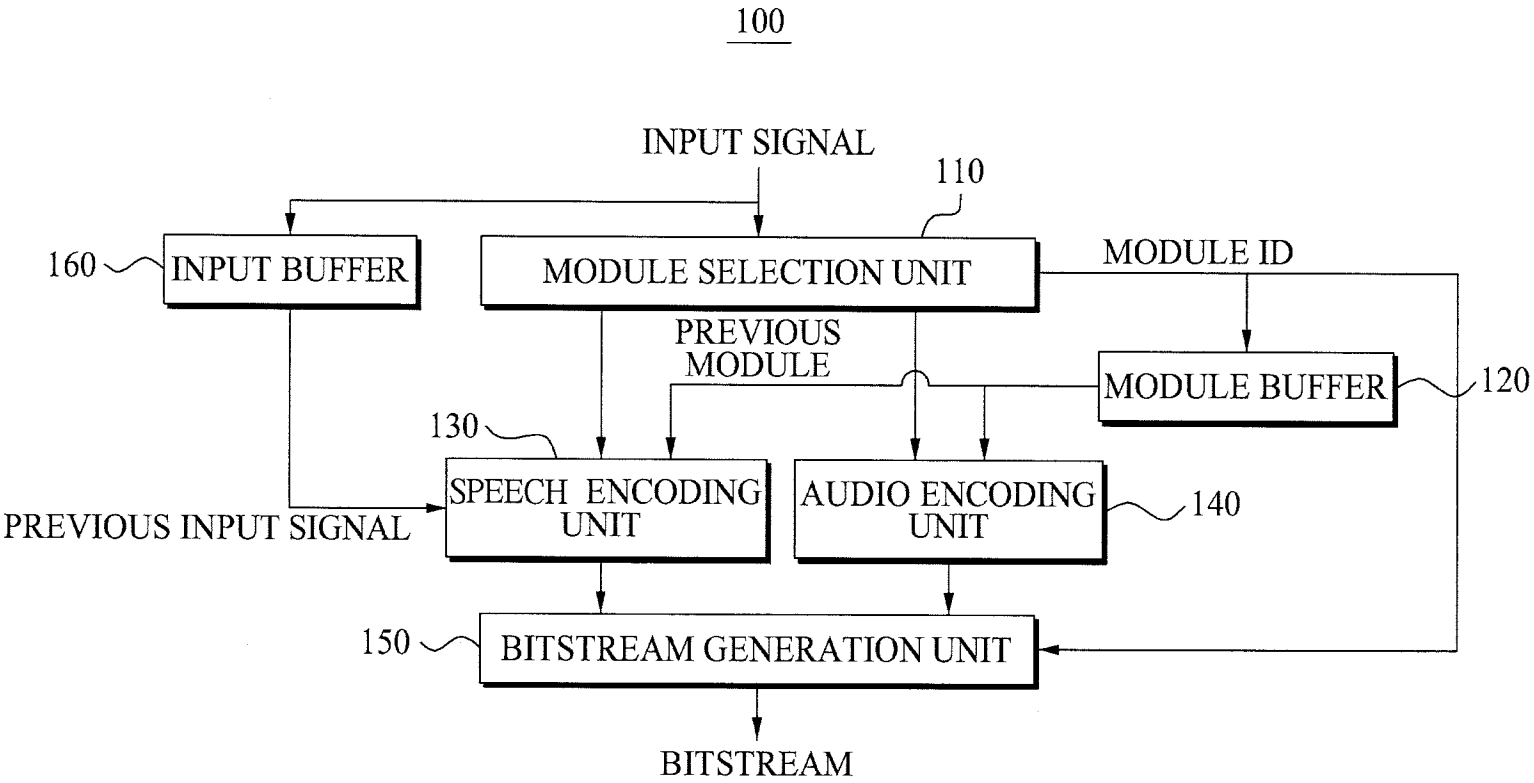
FIG. 1 is a block diagram illustrating an encoding apparatus for integrally encoding a speech signal and an audio signal according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Here, it is assumed that a unified codec includes two encoding modules and two decoding modules, where a speech encoding module and a speech decoding module are in a Code Excitation Linear Prediction (CELP) structure, and an audio encoding module and an audio decoding module perform a Modified Discrete Cosine Transform (MDCT) operation.

FIG. 1 is a block diagram illustrating an encoding apparatus 100 for integrally encoding a speech signal and an audio signal according to an embodiment of the present invention.

Referring to FIG. 1, the encoding apparatus 100 may include a module selection unit 110, a speech encoding unit 130, an audio encoding unit 140, and a bitstream generation unit 150.

Also, the encoding apparatus 100 may further include a module buffer 120 and an input buffer 160.

The module selection unit 110 may analyze a characteristic of an input signal to select a first encoding module for encoding a first frame of the input signal. Here, the first frame may be a current frame of the input signal. Also, the module selection unit 110 may analyze the input signal to determine a module identifier (ID) for encoding the current frame, and may transfer the input signal to the selected first encoding module and input the module ID into the bitstream generation unit 150.

The module buffer 120 may store a module ID of the selected first encoding module, and transmit information of a second encoding module corresponding to a previous frame of the first frame to the speech encoding unit 130 and the audio encoding unit 140.

The input buffer 160 may store the input signal and output a previous input signal that is an input signal of the previous frame. Specifically, the input buffer 160 may store the input signal and output the previous input signal one frame prior to the current frame.

The speech encoding unit 130 may encode the input signal according to a selection of the module selection unit 110 to generate a speech bitstream. Hereinafter, the speech encoding unit 130 will be described in detail with reference to FIG. 2.

Figure 2:
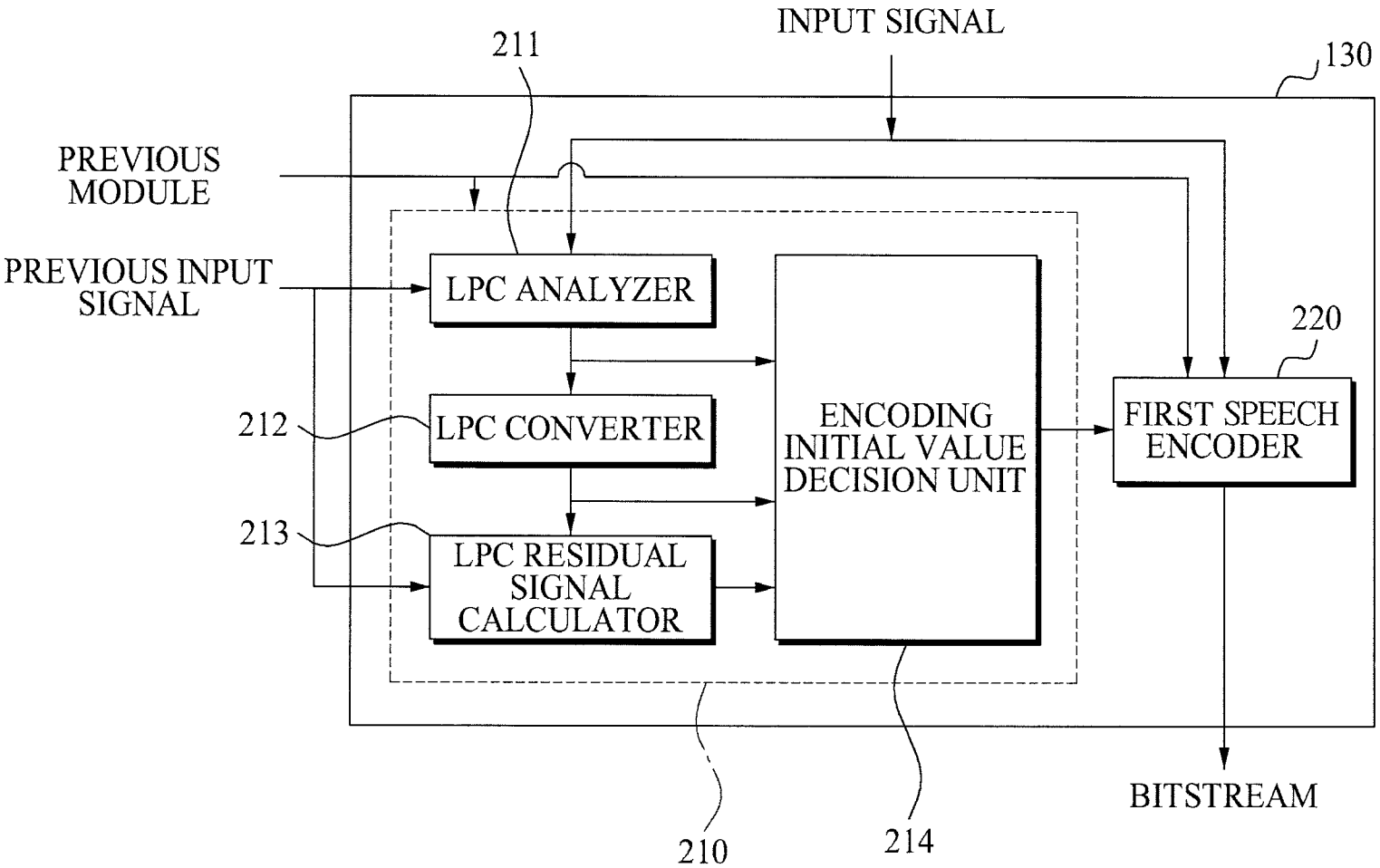
FIG. 2 is a block diagram illustrating an example of a speech encoding unit of FIG. 1.

FIG. 2 is a block diagram illustrating an example of the speech encoding unit 130 of FIG. 1.

Referring to FIG. 2, the speech encoding unit 130 may include an encoding initialization unit 210 and a first speech encoder 220.

When the first encoding module is different from the second encoding module, the encoding initialization unit 210 may determine an initial value for encoding of the first speech encoder 220. Specifically, the encoding initialization unit 210 may receive a previous module and determine the initial value for the first speech encoder 220 only when a previous frame has performed an MDCT operation. Here, the encoding initialization unit 210 may include a Linear Predictive Coder (LPC) analyzer 211, a Linear Spectrum Pair (LSP) converter 212, an LPC residual signal calculator 213, and an encoding initial value decision unit 214.

The LPC analyzer 211 may calculate an LPC coefficient with respect to the previous input signal. Specifically, the LPC analyzer 212 may receive the previous input signal to perform an LPC analysis using the same scheme as the first speech encoder 220 and thereby calculate and output the LPC coefficient corresponding to the previous input signal.

The LSP converter 212 may convert the calculated LPC coefficient to an LSP value.

The LPC residual signal calculator 213 may calculate an LPC residual signal using the previous input signal and the LPC coefficient.

The encoding initial value decision unit 214 may determine the initial value for encoding of the first speech encoder 220 using the LPC coefficient, the LSP value, and the LPC residual signal. Specifically, the encoding initial value decision unit 214 may determine and output the initial value in a form, required by the first speech encoder 220, using the LPC coefficient, the LSP value, the LPC residual signal, and the like.

When the first encoding module is identical to the second encoding module, the first speech encoder 220 may encode the input signal to a CELP structure. Here, when the first encoding module is identical to the second encoding module, the first speech encoder 220 may encode the input signal using an internal initial value of the first speech encoder 220. When the first encoding module is different from the second encoding module, the first speech encoder 220 may encode the input signal using an initial value that is determined by the encoding initialization unit 210. For example, the first speech encoder 220 may receive a previous module having performed encoding for a previous frame one frame prior to a current frame. When the previous frame has performed a CELP operation, the first speech encoder 220 may encode an input signal corresponding to the current frame using a CELP scheme. In this case, the first speech encoder 220 may perform a consecutive CELP operation and thus continue with an encoding operation using internally provided previous information to generate a bitstream. When the previous frame has performed an MDCT operation, the first speech encoder 220 may erase all the previous information for CELP encoding, and perform the encoding operation using the initial value, provided from the encoding initialization unit 210, to generate the bitstream.

Referring again to FIG. 1, the audio encoding unit 140 may encode the input signal according to the selection of the module selection unit 110 to generate an audio bitstream. Hereinafter, the audio encoding unit 140 will be further described in detail with reference to FIGS. 3 and 4.

Figure 3:
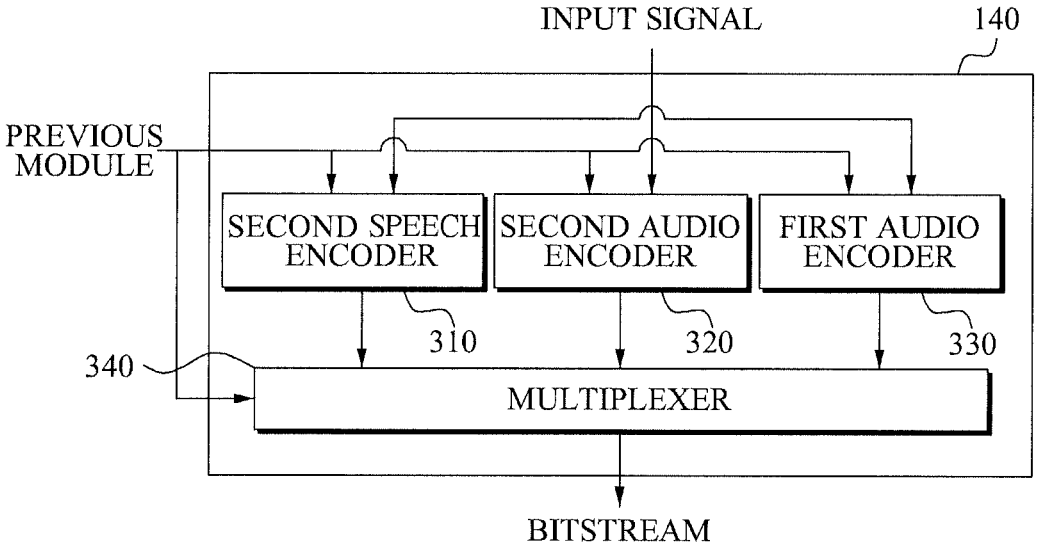
FIG. 3 is a block diagram illustrating an example of an audio encoding unit of FIG. 1.

FIG. 3 is a block diagram illustrating an example of the audio encoding unit 140 of FIG. 1.

Referring to FIG. 3, the audio encoding unit 140 may include a second speech encoder 310, a second audio encoder 320, a first audio encoder 330, and a multiplexer 340.

When the first encoding module is identical to the second encoding module, the first audio encoder 330 may encode the input signal through an MDCT operation. Specifically, the first audio encoder 330 may receive a previous module. When the previous frame has performed the MDCT operation, the first audio encoder 330 may encode an input signal corresponding to a current frame using the MDCT operation to thereby generate a bitstream. The generated bitstream may be input into the multiplexer 340.

Figure 4:
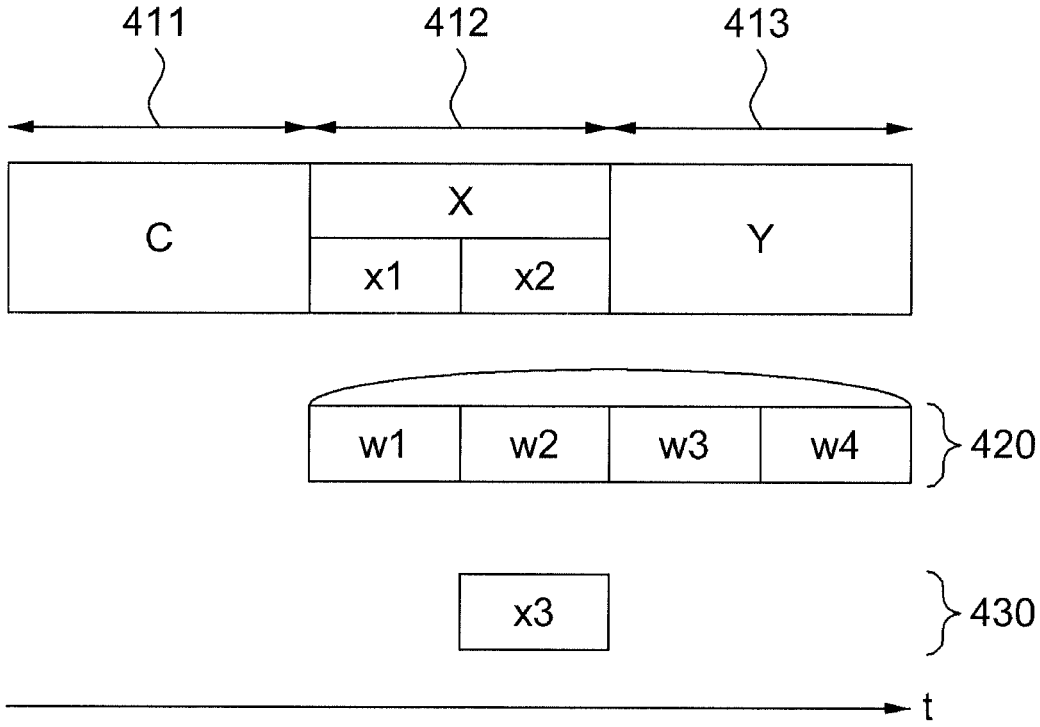
FIG. 4 is a diagram for describing an operation of the audio encoding unit of FIG. 3.

Referring to FIG. 4, X denotes an input signal of a current frame 412. x1 and x2 denote signals that are generated by bisecting the input signal X by a ½ frame length. An MDCT operation of the current frame 412 may be applied to signals X and Y including signal Y corresponding to a subsequent frame 413. MDCT may be executed after multiplying windows w1w2w3w4 420 by signals X and Y. Here, w1, w2, w3, and w4 denote window pieces that are generated by dividing the entire window by a ½ frame length. When the previous frame 411 has performed a CELP operation, the first audio encoder 330 may not perform any operation.

When the first encoding module is different from the second encoding module, the second speech encoder 310 may encode the input signal to a CELP structure. Here, the second speech encoder 310 may receive the previous module. When the previous frame 411 has performed a CELP operation, the second speech encoder 310 may encode signal x1 to output the bitstream, and may input the bitstream into the multiplexer 340. When the previous frame 411 has performed the CELP operation, the second speech encoder 310 may be consecutively connected to the previous frame 411 and thus perform the encoding operation without initialization. When the previous frame 411 has performed the MDCT operation, the second speech encoder 310 may not perform any operation.

When the first encoding module is different from the second encoding module, the second audio encoder 320 may encode the input signal through the MDCT operation. Here, the second audio encoder 320 may receive the previous module. When the previous frame 411 has performed the CELP operation, the second audio encoder 320 may encode the input signal using any one of the following first through third schemes. The first scheme may encode the input signal according to the existing MDCT operation. The second scheme may modify the input signal to be x1=0, and encode the result using a scheme according to the existing MDCT operation. The third scheme may calculate a zero input response x3 430 with respect to an LPC filter obtained after the second speech encoder 310 terminates the encoding operation of signal x1, and may modify signal x2 according to x2=x2−x3 and modify the input signal based on x1=0, and encode the result according to the existing MDCT operation. A signal restoration operation of an audio decoding module (not shown) may be determined depending on a scheme adopted by the second audio encoder 320. When the previous frame has performed the MDCT operation, the second audio encoder 320 may not perform any operation.

For the above encoding operation, the second audio encoder 320 may include a zero input response calculator (not shown) to calculate a zero input response with respect to an LPC filter after terminating an encoding operation of the second speech encoder 310, a first converter (not shown) to convert, to zero, an input signal corresponding to a front ½ sample of the first frame, and a second converter (not shown) to subtract the zero input response from an input signal corresponding to a rear ½ sample of the first frame. The second audio encoder 320 may encode a converted signal of the first converter and a converted signal of the second converter.

The multiplexer 340 may select one of an output of the first audio encoder 330, an output of the second speech encoder 310, and an output of the second audio encoder 330 to generate an output bitstream. Here, the multiplexer 340 may combine bitstreams to generate a final bitstream. When the previous frame performed the MDCT operation, the final bitstream may be the same as the output bitstream of the first audio encoder 330.

Referring again to FIG. 1, the bitstream generation unit 150 may combine the module ID of the selected first encoding module and the bitstream of the selected first encoding module to generate the output bitstream. The bitstream generation unit 150 may combine the module ID and a bitstream corresponding to the module ID to thereby generate the final bitstream.

Figure 5:
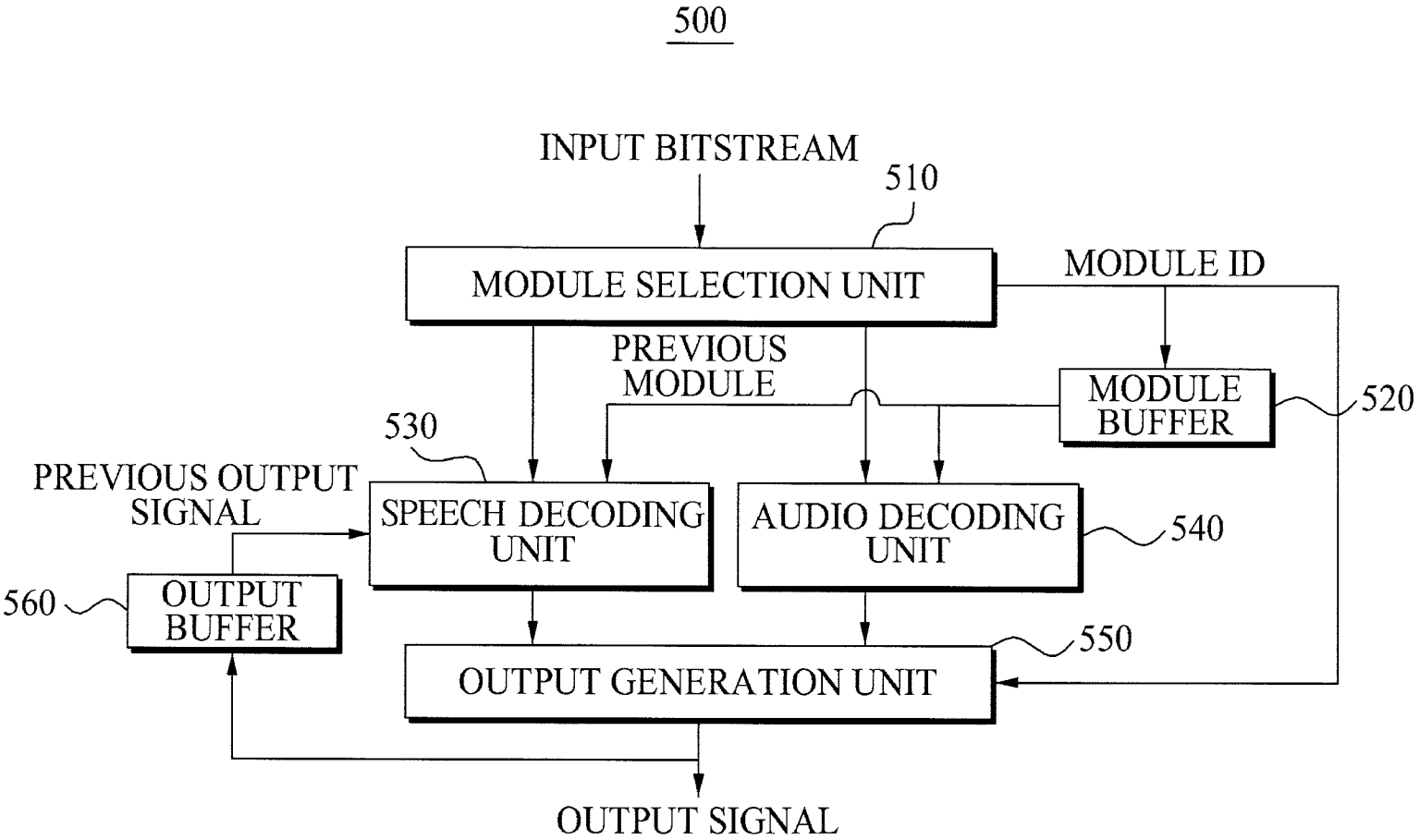
FIG. 5 is a block diagram illustrating a decoding apparatus for integrally decoding a speech signal and an audio signal according to an embodiment of the present invention.

FIG. 5 is a block diagram illustrating a decoding apparatus 500 for integrally decoding a speech signal and an audio signal according to an embodiment of the present invention.

Referring to FIG. 5, the decoding apparatus 500 may include a module selection unit 510, a speech decoding unit 530, an audio decoding unit 540, and an output generation unit 550. Also, the decoding apparatus 500 may further include a module buffer 520 and an output buffer 560.

The module selection unit 510 may analyze a characteristic of an input bitstream to select a first decoding module for decoding a first frame of the input bitstream. Specifically, the module selection unit 510 may analyze a module, transmitted from the input bitstream, to output a module ID and to transfer the input bitstream to a corresponding decoding module.

The speech decoding unit 530 may decode the input bitstream according to a selection of the module selection unit 510 to generate a speech signal. Specifically, the speech decoding unit 530 may perform a CELP-based speech decoding operation. Hereinafter, the speech decoding unit 530 will be further described in detail with reference to FIG. 6.

Figure 6:
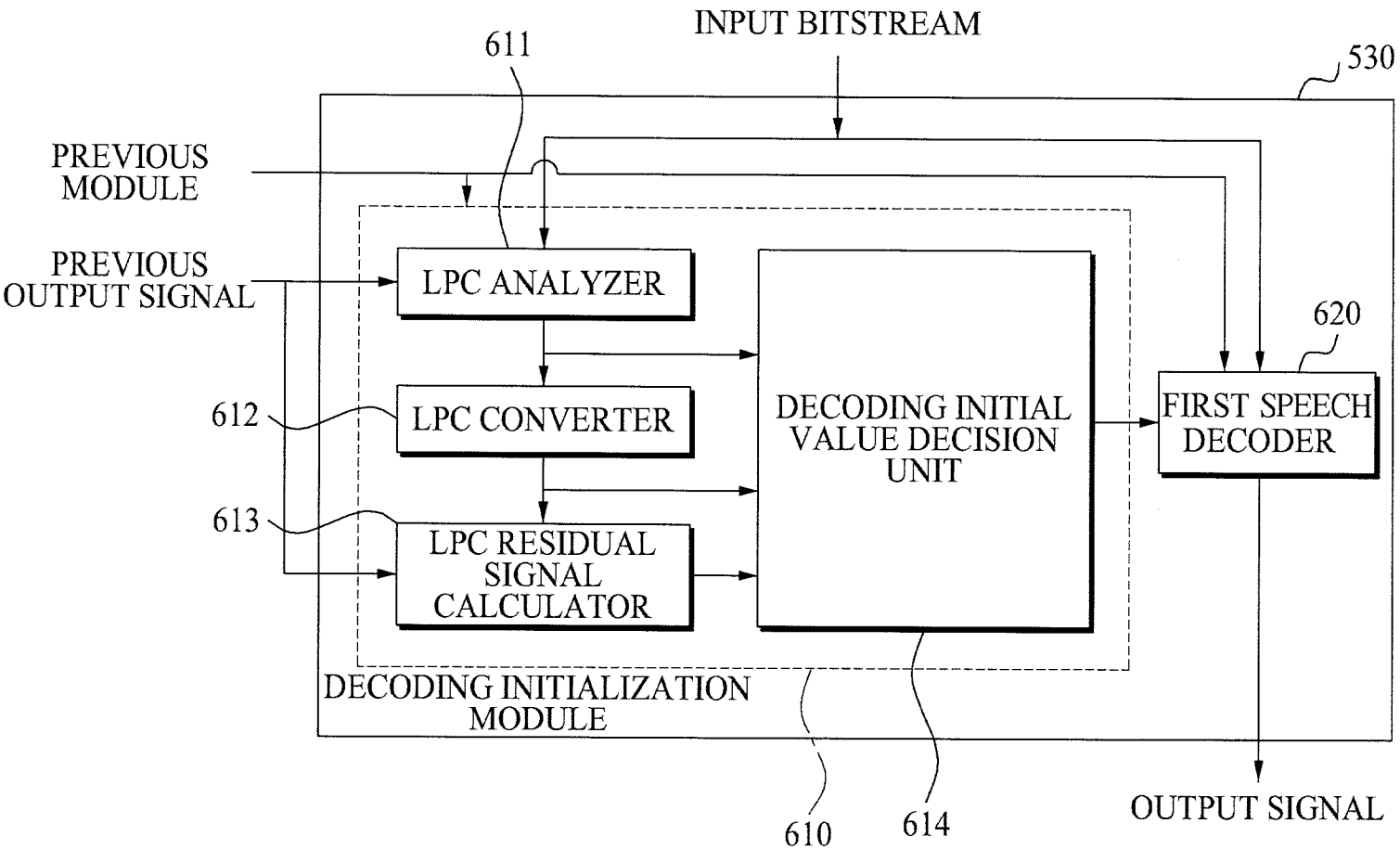
FIG. 6 is a block diagram illustrating an example of a speech decoding unit of FIG. 5.

FIG. 6 is a block diagram illustrating an example of the speech decoding unit 530 of FIG. 5.

Referring to FIG. 6, the speech decoding unit 530 may include a decoding initialization unit 610 and a first speech decoder 620.

When the first decoding module is different from the second decoding module, the decoding initialization unit 610 may determine an initial value for decoding of the first speech decoder 620. Specifically, the decoding initialization unit 610 may receive a previous module. Only when a previous frame has performed an MDCT operation may the decoding initialization unit 610 determine the initial value to be provided for the first speech decoder 620. Here, the decoding initialization unit 610 may include an LPC analyzer 611, an LSP converter 612, an LPC residual signal calculator 613, and a decoding initial value decision unit 614.

The LPC analyzer 611 may calculate an LPC coefficient with respect to the previous output signal. Specifically, the LPC analyzer 611 may receive the previous output signal to perform an LPC analysis using the same scheme as the first speech decoder 620 and thereby calculate and output an LPC coefficient corresponding to the previous output signal.

The LSP converter 612 may convert the calculated LPC coefficient to an LSP value.

The LPC residual signal calculator 613 may calculate an LPC residual signal using the previous output signal and the LPC coefficient.

The decoding initial value decision unit 614 may determine the initial value for decoding of the first speech decoder 620 using the LPC coefficient, the LSP value, and the LPC residual signal. Specifically, the decoding initial value decision unit 614 may determine and output the initial value in a form, required by the first speech decoder 620, using the LPC coefficient, the LPC value, the LPC residual signal, and the like.

When the first decoding module is identical to the second decoding module, the first speech decoder 620 may decode the input bitstream to a CELP structure. Here, when the first decoding module is identical to the second decoding module, the first speech decoder 620 may decode the input bitstream using an internal initial value of the first speech decoder 620. When the first decoding module is different from the second decoding module, the first speech decoder 620 may decode the input bitstream using an initial value that is determined by the decoding initialization unit 610. Specifically, the first speech decoder 620 may receive a previous module having performed decoding for a previous frame one frame prior to a current frame. When the previous frame has performed a CELP operation, the first speech decoder 620 may decode input bitstream corresponding to the current frame using a CELP scheme. In this case, the first speech decoder 620 may perform a consecutive CELP operation and thus continue with a decoding operation using internally provided previous information to generate an output signal. When the previous frame has performed an MDCT operation, the first speech decoder 620 may erase all the previous information for CELP decoding, and perform the decoding operation using the initial value, provided from the decoding initialization unit 610, to generate the output signal.

Referring again to FIG. 5, the audio decoding unit 540 may decode the input bitstream according to the selection of the module selection unit 510 to generate an audio signal. Hereinafter, the audio decoding unit 540 will be further described in detail with reference to FIGS. 7 and 8.

Figure 7:
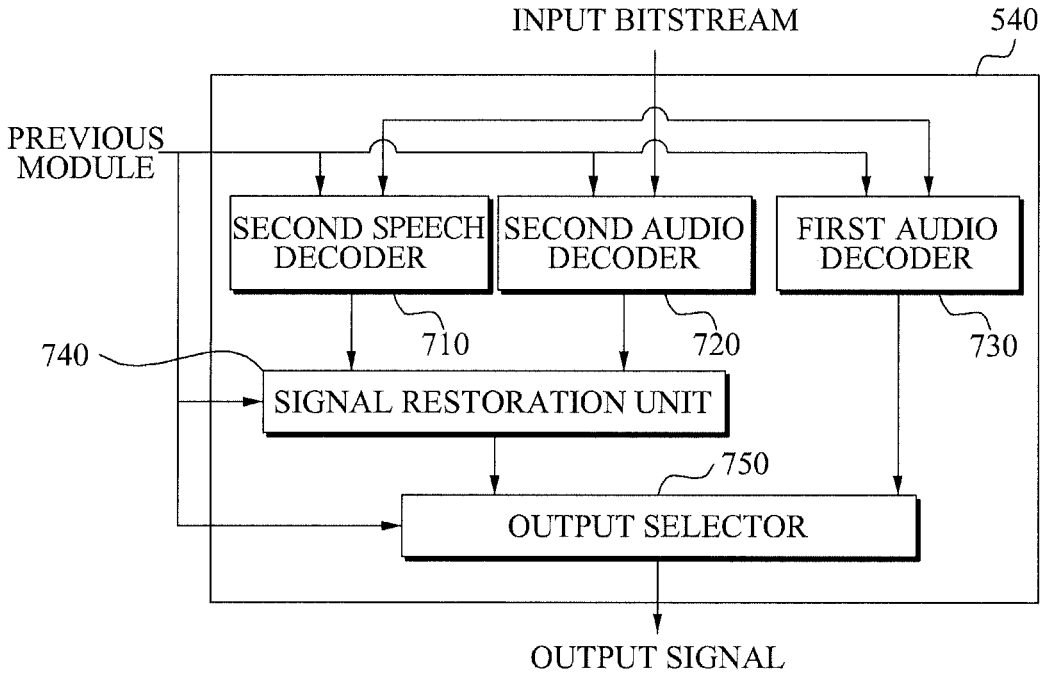
FIG. 7 is a block diagram illustrating an example of an audio decoding unit of FIG. 5.

FIG. 7 is a block diagram illustrating an example of the audio decoding unit 540 of FIG. 5.

Referring to FIG. 7, the audio decoding unit 540 may include a second speech decoder 710, a second audio decoder 720, a first audio decoder 730, a signal restoration unit 740, and an output selector 750.

When the first decoding module is identical to the second decoding module, the first audio decoder 730 may decode the input bitstream through an Inverse MDCT (IMDCT) operation. Specifically, the first audio decoder 730 may receive a previous module. When a previous frame has performed the IMDCT operation, the first audio decoder 730 may decode an input bitstream corresponding to the current frame using the IMDCT operation to thereby generate an output signal. Specifically, the first audio decoder 730 may receive an input bitstream of the current frame, perform the IMDCT operation according to an existing technology, apply a window to thereby perform a time-domain aliasing cancellation (TDAC) operation, and output a final output signal. When the previous frame performs a CELP operation, the first audio decoder 730 may not perform any operation.

Figure 8:
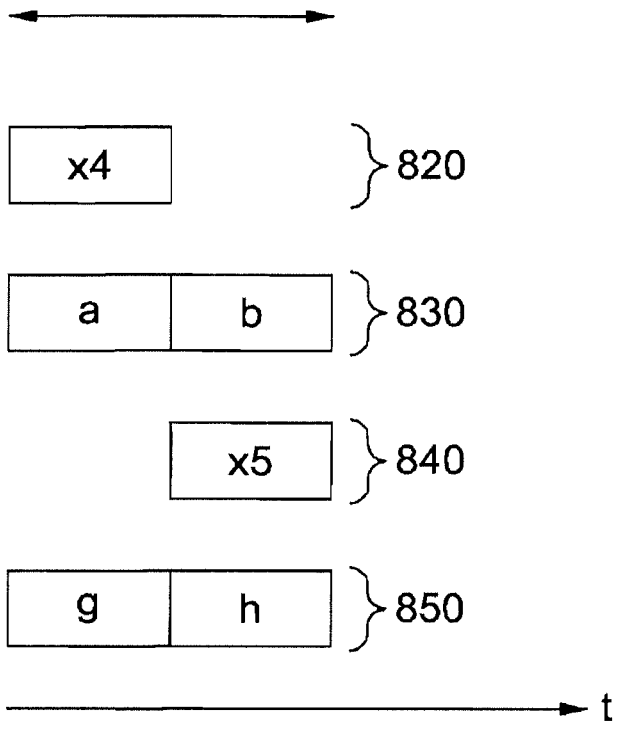
FIG. 8 is a diagram for describing an operation of the audio decoding unit of FIG. 7.

Referring to FIG. 8, when the first decoding module is different from the second decoding module, the second speech decoder 710 may decode the input bitstream to a CELP structure. Specifically, the second speech decoder 710 may receive the previous module. When the previous frame has performed the CELP operation, the second speech decoder 710 may decode the input bitstream according to an existing speech decoding scheme to generate an output signal. Here, the output signal of the second speech decoder 710 may be x4 820 and have a ½ frame length. Since the previous frame has performed the CELP operation, the second speech decoder 710 may be consecutively connected to the previous frame and thus perform the decoding operation without initialization.

When the first decoding module is different from the second decoding module, the second audio decoder 720 may decode the input bitstream through the IMDCT operation. Here, after the IMDCT operation, the second audio decoder 720 may apply only a window and obtain an output signal without performing the TDAC operation. Also, in FIG. 8, ab 830 may denote the output signal of the second audio decoder 720. a and b may be defined as signals having a ½ frame length.

The signal restoration unit 740 may calculate a final output from an output of the second speech decoder 710 and an output of the second audio decoder 720. Also, the signal restoration unit 710 may obtain a final output signal of the current frame and define the output signals as gh 850 as shown in FIG. 8. Here, g and h may be defined as signals having a ½ frame length. The signal restoration unit 740 may define g=x4 at all times and decode signal h using one of the following schemes according an operation of the second audio encoder. A first scheme may obtain h according to the following Equation 1. Here, a general window operation is assumed. In the following Equation 1, R denotes time-axis rotating a signal based on a ½ frame length.

$$h = \frac{b + w2w1_R \times 4_R}{w2w2}, \quad \text{[Equation 1]}$$

wherein h denotes the output signal corresponding to a rear ½ sample of the first frame, b denotes an output signal of the second audio decoder 720, x4 denotes an output signal of the second speech decoder 710, w1 and w2 denote windows, $w1_R$ denotes a signal that is generated by performing a time-axis rotation for w1 based on a ½ frame length, and $x4_R$ denotes a signal that is generated by performing the time-axis rotation for x4 based on a ½ frame length.

A second scheme may obtain h according to the following Equation 2:

$$h = \frac{b}{w2w2}, \quad \text{[Equation 2]}$$

where h denotes the output signal corresponding to the rear ½ sample of the first frame, b denotes the output signal of the second audio decoder 720, and w2 denotes a window.

A third scheme may obtain h according to the following Equation 3:

$$h = \frac{b}{w2w2} + x5, \quad \text{[Equation 3]}$$

where h denotes the output signal corresponding to the rear ½ sample of the first frame, b denotes the output signal of the second audio decoder 720, w2 denotes a window, and x5 840 denotes a zero input response with respect to an LPC filter after decoding the output signal of the second speech decoder 710.

When the previous frame has performed the MDCT operation, the second speech decoder 710, the second audio decoder 720, and the signal restoration unit 740 may not perform any operation.

The output selector 750 may select and output one of an output of the signal restoration unit 740 and an output of the first audio decoder 730.

Referring again to FIG. 5, the output generation unit 750 may select one of the speech signal of the speech decoding unit 530 and the audio signal of the audio decoding unit 540 according to the selection of the module selection unit 510 to generate the output signal. Specifically, the output generation unit 750 may select the output signal according to the module ID to output the selected output signal as the final output signal.

The module buffer 520 may store a module ID of the selected first decoding module, and transmit information of a second decoding module corresponding to a previous frame of the first frame to the speech decoding unit 530 and the audio decoding unit 540. Specifically, the module buffer 520 may store the module ID to output a previous module corresponding to a previous module ID that is one frame prior to a current frame.

The output buffer 560 may store the output signal and output a previous output signal that is an output signal of the previous frame.

Figure 9:
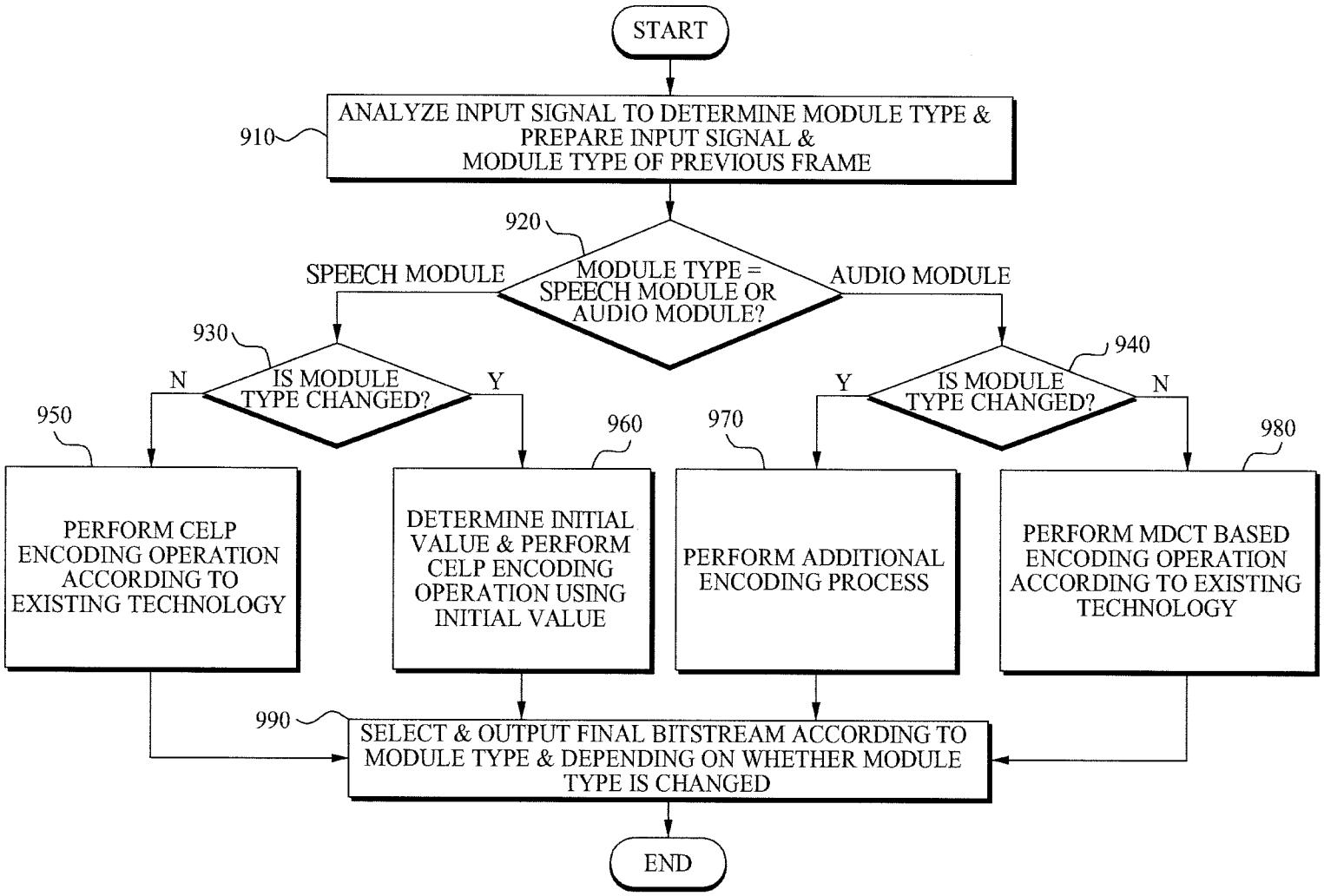
FIG. 9 is a flowchart illustrating an encoding method of integrally encoding a speech signal and an audio signal according to an embodiment of the present invention.

FIG. 9 is a flowchart illustrating an encoding method of integrally encoding a speech signal and an audio signal according to an embodiment of the present invention.

Referring to FIG. 9, in operation 910, the encoding method may analyze an input signal to determine a module type of an encoding module for encoding a current frame, and buffer the input signal to prepare a previous frame input signal, and may store a module type of the current frame to prepare a module type of a previous frame.

In operation 920, the encoding method may determine whether the determined module type is a speech module or an audio module.

When the determined module type is the speech module in operation 920, the encoding method may determine whether the module type is changed in operation 930.

When the module type is not changed in operation 930, the encoding method may perform a CELP encoding operation according to an existing technology in operation 950. Conversely, when the module type is changed in operation 930, the encoding method may perform an initialization according to an operation of the encoding initialization module to determine an initial value, and perform the CELP encoding operation using the initial value in operation 960.

When the determined module type is the audio module in operation 920, the encoding method may determine whether the module type is changed in operation 940.

When the module type is changed in operation 940, the encoding method may perform an additional encoding process in operation 970. During the additional encoding process, the encoding method may perform a CELP-based encoding for an input signal corresponding to a ½ frame length and perform a second audio encoding operation for the entire frame length. Conversely, when the module type is not changed in operation 940, the encoding method may perform an MDCT-based encoding operation according to an existing technology in operation 980.

In operation 990, the encoding method may select and output a final bitstream according to the module type and depending on whether the module type is changed.

Figure 10:
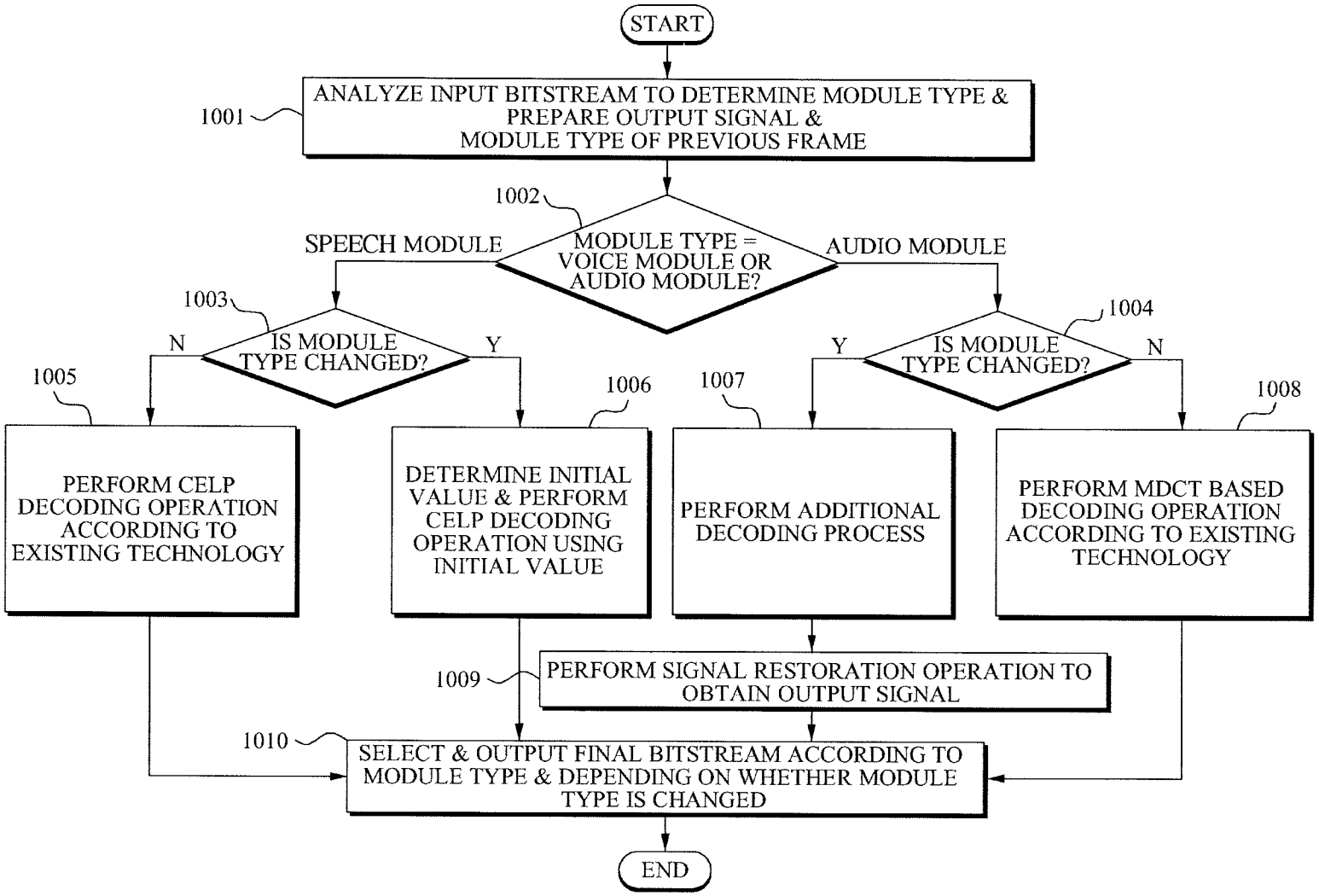
FIG. 10 is a flowchart illustrating a decoding method of integrally decoding a speech signal and an audio signal according to an embodiment of the present invention.

FIG. 10 is a flowchart illustrating a decoding method of integrally decoding a speech signal and an audio signal according to an embodiment of the present invention.

Referring to FIG. 10, in operation 1001, the decoding method may determine a module type of a decoding module of a current frame based on input bitstream information to prepare a previous frame output signal, and store the module type of the current frame to prepare a module type of a previous frame.

In operation 1002, the decoding method may determine whether the determined module type is a speech module or an audio module.

When the determined module type is the speech module in operation 1002, the decoding method may determine whether the module type is changed in operation 1003.

When the module type is not changed in operation 1003, the decoding method may perform a CELP decoding operation according to an existing technology in operation 1005. Conversely, when the module type is changed in operation 1003, the decoding method may perform an initialization according to an operation of the decoding initialization module to obtain an initial value, and perform the CELP decoding operation using the initial value in operation 1006.

When the determined module type is the audio module in operation 1002, the decoding method may determine whether the module type is changed in operation 1004.

When the module type is changed in operation 1004, the decoding method may perform an additional decoding process in operation 1007. During the additional decoding process, the decoding method may perform a CELP-based decoding for the input bitstream to obtain an output signal corresponding to a ½ frame length, and perform a second audio decoding operation for the input bitstream.

Conversely, when the module type is not changed in operation 1004, the decoding method may perform an MDCT-based decoding operation according to an existing technology in operation 1008.

In operation 1009, the decoding method may perform a signal restoration operation to obtain an output signal. In operation 1010, the decoding method may select and output a final signal according to the module type and depending on whether the module type is changed.

As described above, according to embodiments of the present invention, there may be provided an apparatus and method for integrally encoding and decoding a speech signal and an audio signal that may unify a speech codec module and an audio codec module, selectively apply a codec module according to a characteristic of an input signal, and thereby may enhance a performance.

Also, according to embodiments of the present invention, when a selected codec module is changed over time, information associated with a previous module may be used. Through this, it is possible to solve distortion occurring due to a discontinuous module operation. In addition, when previous module information for overlapping is not provided from an MDCT module demanding a TDAC operation, an additional scheme may be adopted. Accordingly, the TDAC operation may be enabled to thereby perform a normal MDCT-based codec operation.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An encoding apparatus for integrally encoding a speech signal and an audio signal, the encoding apparatus comprising:

a module selection unit to analyze a characteristic of an input signal and to select a first encoding module for encoding a current frame of the input signal;

a speech encoding unit to encode the input signal according to a selection of the module selection unit and to generate a speech bitstream;

an audio encoding unit to encode the input signal according to the selection of the module selection unit and to generate an audio bitstream;

a module buffer to transmit information of a second encoding module corresponding to a previous frame of the current frame to the speech encoding unit and the audio encoding unit; and a bitstream generation unit to generate an output bitstream from the speech encoding unit or the audio encoding unit according to the selection of the module selection unit, wherein, when an overlap operation between the previous frame and the current frame occurs, the speech encoding unit encodes a half sample of the previous frame having a speech characteristic as additional information to decode a current frame having an audio characteristic according to MDCT(Modified Discrete Cosine Transform) at a decoding apparatus, wherein the bitstream generation unit generates the output bitstream including module information for the current frame selected by the module selection unit, the speech bitstream generated from the speech encoding unit and the audio bitstream generated from the audio encoding unit.

2. The encoding apparatus of claim 1, wherein the module selection unit extracts the module information of the selected first encoding module and transmits the module information to the bitstream generation unit.

3. The encoding apparatus of claim 1, wherein the speech encoding unit comprises:

a first speech encoder to encode the input signal to a Code Excitation Linear Prediction (CELP) structure when the first encoding module is identical to the second encoding module; and an encoding initialization unit to determine an initial value for encoding of the first speech encoder when the first encoding module is different from the second encoding module.

4. The encoding apparatus of claim 3, wherein:

when the first encoding module is identical to the second encoding module, the first speech encoder encodes the input signal using an internal initial value of the first speech encoder, and when the first encoding module is different from the second encoding module, the first speech encoder encodes the input signal using an initial value that is determined by the encoding initialization unit.

5. The encoding apparatus of claim 3, wherein the encoding initialization unit comprises:

a Linear Predictive Coder (LPC) analyzer to calculate an LPC coefficient with respect to the previous input signal;

a Linear Spectrum Pair (LSP) converter to convert the calculated LPC coefficient to an LSP value;

an LPC residual signal calculator to calculate an LPC residual signal using the previous input signal and the LPC coefficient; and an encoding initial value decision unit to determine the initial value for encoding of the first speech encoder using the LPC coefficient, the LSP value, and the LPC residual signal.

6. The encoding apparatus of claim 1, wherein the audio encoding unit comprises:

a first audio encoder to encode the input signal through a Modified Discrete Cosine Transform (MDCT) operation when the first encoding module is identical to the second encoding module;

a second speech encoder to encode the input signal to a CELP structure when the first encoding module is different from the second encoding module;

a second audio encoder to encode the input signal through the MDCT operation when the first encoding module is different from the second encoding module; and a multiplexer to select one of an output of the first audio encoder, an output of the second speech encoder, and an output of the second audio encoder to generate the output bitstream.

7. The encoding apparatus of claim 6, wherein, when the first encoding module is different from the second encoding module, the second speech encoder encodes an input signal corresponding to a front half sample of the current frame.

8. The encoding apparatus of claim 6, wherein the second audio encoder comprises:

a zero input response calculator to calculate a zero input response with respect to an LPC filter after terminating an encoding operation of the second speech encoder;

a first converter to convert, to zero, an input signal corresponding to a front ½ sample of the current frame; and a second converter to subtract the zero input response from an input signal corresponding to a rear half sample of the current frame, wherein the second audio encoder encodes a converted signal of the first converter and a converted signal of the second converter.

9. A decoding apparatus for integrally decoding a speech signal and an audio signal, the decoding apparatus comprising:

a module selection unit to analyze a characteristic of an input bitstream and to select a first decoding module for decoding a current frame of the input bitstream;

a speech decoding unit to decode the input bitstream according to a selection of the module selection unit and to generate a speech signal;

an audio decoding unit to decode the input bitstream according to the selection of the module selection unit and to generate an audio signal;

a module buffer to transmit information of a second decoding module corresponding to a previous frame of the current frame to the speech decoding unit and the audio decoding unit; and an output generation unit to select one of the speech signal of the speech decoding unit and the audio signal of the audio signal according to the selection of the module selection unit and to output an output signal, wherein the speech decoding unit decodes a half sample of a previous frame having a speech characteristic as additional information, wherein, when an overlap operation between the previous frame and the current frame occurs, the audio decoding unit decodes a current frame according to MDCT(Modified Discrete Cosine Transform) by compensating the current frame based on the additional information.

10. The decoding apparatus of claim 9, wherein the speech decoding unit comprises:

a first speech decoder to decode the input stream to a CELP structure when the first decoding module is identical to the second decoding module; and a decoding initialization unit to determine an initial value for decoding of the first speech decoder when the first decoding module is different from the second decoding module.

11. The decoding apparatus of claim 10, wherein:

when the first decoding module is identical to the second decoding module, the first speech decoder decodes the input bitstream using an internal initial value of the first speech decoder, and when the first decoding module is different from the second decoding module, the first speech decoder decodes the input bitstream using an initial value that is determined by the decoding initialization unit.

12. The decoding apparatus of claim 9, wherein the decoding initialization unit comprises:

an LPC analyzer to calculate an LPC coefficient with respect to the previous output signal;

an LSP converter to convert the calculated LPC coefficient to an LSP value;

an LPC residual signal calculator to calculate an LPC residual signal using the previous output signal and the LPC coefficient; and a decoding initial value decision unit to determine the initial value for decoding of the first speech decoder using the LPC coefficient, the LSP value, and the LPC residual signal.

13. The decoding apparatus of claim 9, wherein the audio decoding unit comprises:

a first audio decoder to decode the input bitstream through an Inverse MDCT (IMDCT) operation when the first decoding module is identical to the second decoding module;

a second speech decoder to decode the input bitstream to a CELP structure when the first decoding module is different from the second decoding module;

a second audio decoder to decode the input bitstream through the IMDCT operation when the first decoding module is different from the second decoding module; and a signal restoration unit to calculate a final output from an output of the second speech decoder and an output of the second audio decoder; and an output selector to select and output one of an output of the signal restoration unit and an output of the first audio decoder.

14. The decoding apparatus of claim 13, wherein, when the first decoding module is different from the second decoding module, the second speech decoder decodes an input bitstream corresponding to a front half sample of the current frame to output an input signal.

15. The decoding apparatus of claim 13, wherein the signal restoration unit determines the output of the second speech decoder as an output signal corresponding to a front half sample of the current frame.

* * * * *